US006373957B1

(12) United States Patent
Stewart

(10) Patent No.: US 6,373,957 B1
(45) Date of Patent: Apr. 16, 2002

(54) LOUDSPEAKER STRUCTURE

(75) Inventor: John Sloan Stewart, Bloomington, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 09/854,801

(22) Filed: May 14, 2001

(51) Int. Cl.[7] ..... H04R 25/00
(52) U.S. Cl. ..... 381/397; 381/412; 381/420
(58) Field of Search ..... 381/396, 397, 381/412, 420, FOR 154, FOR 159, FOR 152

(56) References Cited

U.S. PATENT DOCUMENTS

| | | | |
|---|---|---|---|
| 2,551,447 | A | 5/1951 | Marquis |
| 3,991,286 | A | 11/1976 | Henricksen |
| 4,068,103 | A | 1/1978 | King et al. |
| 4,289,937 | A | 9/1981 | Ikeda et al. |
| 4,567,959 | A | 2/1986 | Prophit |
| 4,592,087 | A | 5/1986 | Killion |
| 4,625,328 | A | 11/1986 | Freadman |
| 4,727,583 | A | 2/1988 | Weber |
| 4,811,403 | A | 3/1989 | Henricksen et al. |
| 4,933,975 | A | 6/1990 | Button |
| 5,042,072 | A | 8/1991 | Button |
| 5,062,140 | A | 10/1991 | Inanaga et al. |
| 5,097,513 | A | 3/1992 | Jordan et al. |
| 5,151,943 | A | 9/1992 | VanGelder |
| 5,166,982 | A | 11/1992 | Shintaku |
| 5,357,586 | A | 10/1994 | Nordschow et al. |
| 5,381,483 | A | 1/1995 | Grau |
| 5,390,257 | A | 2/1995 | Oslac et al. |
| 5,402,503 | A | 3/1995 | Prokisch |
| 5,426,707 | A | 6/1995 | Wijnker |
| 5,497,428 | A | 3/1996 | Rojas |

FOREIGN PATENT DOCUMENTS

| | | |
|---|---|---|
| DE | 296 08 421 | 9/1996 |
| EP | 0 122 663 | 4/1984 |
| JP | 49-45291 | 12/1974 |
| JP | 59-189796 | 10/1984 |
| JP | 63-253799 | 10/1988 |
| JP | 4-53112 | 12/1992 |

*Primary Examiner*—Huyen Le
(74) *Attorney, Agent, or Firm*—Barnes & Thornburg

(57) ABSTRACT

A loudspeaker comprises a motor stator providing an air gap, a voice coil, a support for supporting the voice coil in the air gap, a diaphragm coupled to the voice coil for reciprocation with the voice coil, and a frame for supporting the diaphragm. The motor stator comprises a back wall and a sidewall defining a somewhat cup-shaped interior, and a center pole comprising a permanent magnet. The center pole comprises a thermally relatively less conductive material. A passageway is provided through the center pole. A heat sink has a first portion for surmounting the center pole. The first portion is oriented adjacent the air gap. A second portion is coupled to the first portion in heat conducting relation and extends through the passageway to conduct heat away from the air gap through the passageway. The first and second portions comprise a thermally relatively more conductive material.

8 Claims, 2 Drawing Sheets

LOUDSPEAKER STRUCTURE

TECHNICAL FIELD AND BACKGROUND ART

This invention relates to dynamic, or moving coil, loudspeakers. A great variety of constructions for such loudspeakers are known. The following listed U.S. patents are illustrative, but by no means representative of this variety: U.S. Pat. Nos. 3,991,286; 4,289,937; 5,042,072; 5,062,140; 5,151,943; 5,357,586; 5,381,483; 5,390,257; 5,402,503; 5,426,707; and, 5,497,428. No representation is intended by this listing that a thorough search of all relevant prior art has been conducted, or that the listed prior art references are the most relevant prior art, or that there is no more relevant prior art.

SUMMARY OF THE INVENTION

According to the invention, a loudspeaker comprises a motor stator providing an air gap, a voice coil, a support for supporting the voice coil in the air gap, a diaphragm coupled to the voice coil for reciprocation with the voice coil, and a frame for supporting the diaphragm. The motor stator comprises a back wall and a sidewall defining a somewhat cup-shaped interior, and a center pole comprising a permanent magnet. At least one of the back wall, the sidewall and the center pole comprises a thermally relatively less conductive material. A passageway is provided through the center pole. A heat sink has a first portion for surmounting the center pole. The first portion is oriented adjacent the air gap. A second portion is coupled to the first portion in heat conducting relation and extends through the passageway to conduct heat away from the air gap through the passageway. The first and second portions comprise thermally relatively more conductive material.

According to illustrative embodiments, a passageway is provided through the back wall. The heat sink further comprises a third portion lying on a side of the back wall opposite the interior. The third portion is coupled to the second portion in heat conducting relation to conduct heat away from the second portion.

According to illustrative embodiments, the first and second portions are formed as a single piece.

According to illustrative embodiments, the second and third portions comprise complementary attachment means.

According to an illustrative embodiment, the third portion includes a first surface adjacent the back wall and a second surface opposite the first surface. The second surface is contoured, such as, for example, by the addition of fins to promote radiation of heat therefrom.

According to an illustrative embodiment, the back wall comprises a first surface facing the interior and an opposite second surface. The second surface is contoured to promote radiation of heat therefrom.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
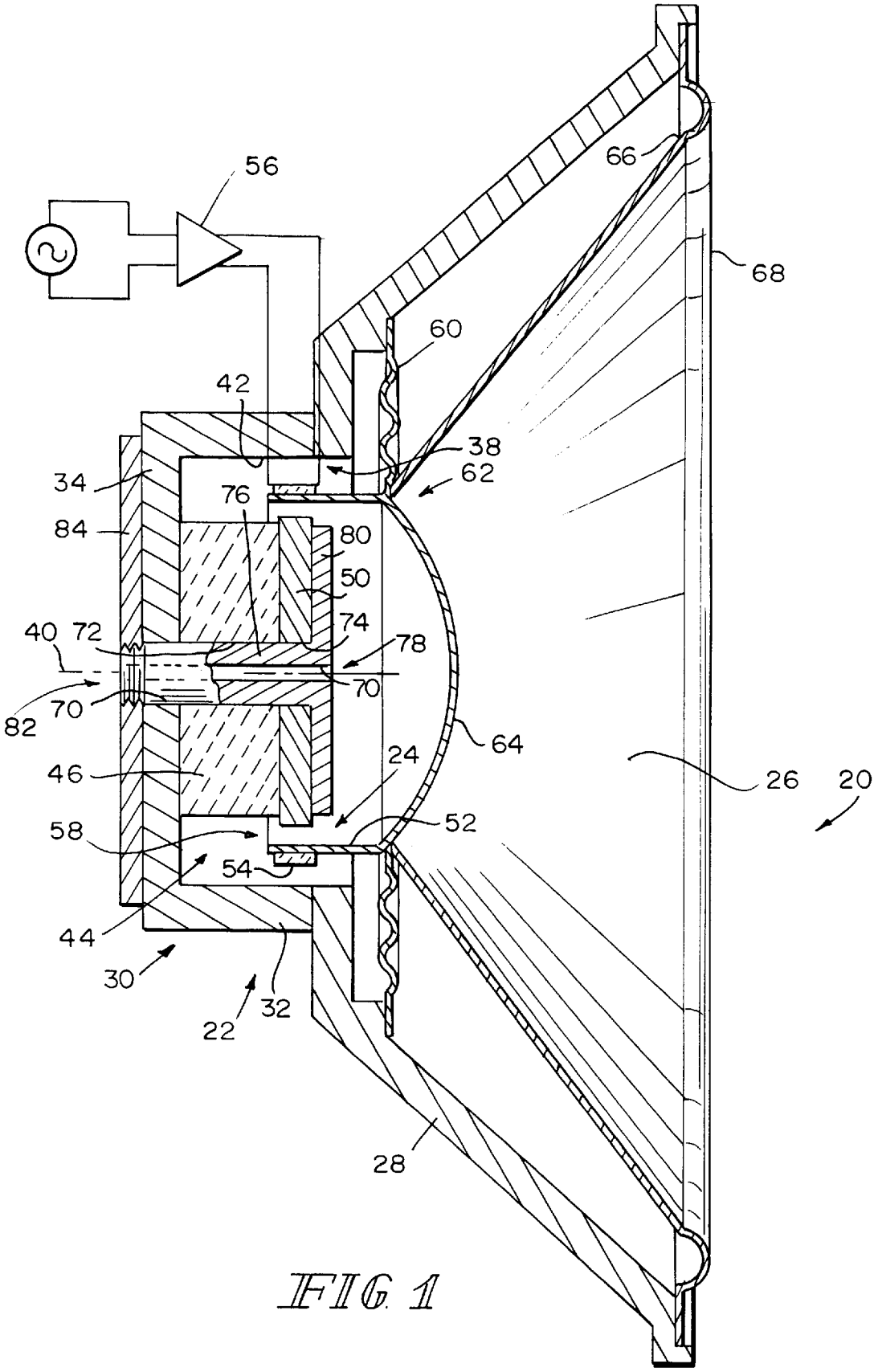
FIG. 1 illustrates an axial sectional side elevational view through a dynamic loudspeaker constructed according to the invention.

Referring now to FIG. 1, a dynamic loudspeaker 20 includes a voice coil motor stator 22, a voice coil motor armature 24, a diaphragm 26 and a frame 28. The voice coil motor stator 22 includes a pot shell 30 constructed from a ferromagnetic material such as, for example, soft iron. The illustrative pot shell 30 includes a generally cylindrical perimetral sidewall 32 and a back wall 34 joined together at the bottom of the sidewall 32 and outer perimeter of the back wall 34 to make the pot shell somewhat pot- or cup-shaped in configuration. Although the illustrated pot shell 30 does not include one, the pot shell may have a front wall which extends from the top or front 38 of sidewall 32 inwardly toward an axis 40 of the pot shell 30 to form the outer pole 42 of the voice coil motor stator 22.

Stator 22 also includes a center pole 44 which extends upwardly or forwardly from back wall 34 along axis 36 toward the top or front of pot shell 30. Center pole 44 conventionally includes a permanent magnet 46, which illustratively is a right circular cylindrical ceramic magnet having a relatively lower thermal conductivity. Magnet 46 illustratively has its poles oriented along axis 40. A center pole piece 50, which illustratively is a right circular cylindrical, somewhat disk-shaped plate constructed from a ferromagnetic material such a soft iron, is provided on the top or front pole of magnet 46. The components 30, 44, 50 of stator 22 illustratively are assembled with the aid of, for example, heat resistant adhesives, threaded fasteners and the like.

The armature 24 includes a coil former 52 constructed from, for example, a lightweight, electrically insulative resin or paperboard material. The voice coil 54 is wound on coil former and is excited by current supplied from an audio amplifier 56 to reciprocate in the air gap 58 defined between outer pole 42 and center pole piece 50 in accordance with known principles. Coil former 52, and thereby voice coil 54, is maintained generally centered in the air gap 58 by a centering spider 60 having pleated compliance to permit reciprocation of the voice coil 54. The inner perimeter of spider 60 is coupled to the upper or forward end of coil former 52 and the outer perimeter of spider 60 is coupled to frame 28 or to the top or front 38 of pot shell 30.

The apex 62 of the somewhat cone-shaped, treated paper or other lightweight material diaphragm 26 is also coupled to the upper or forward end of coil former 52. A dust cap 64 normally covers the apex 62 of diaphragm 26 to reduce the likelihood of entry of contaminants into the air gap 58. The outer and upper or forward perimeter 66 of diaphragm 26 is coupled through a compliance 68 to the supporting frame 28. Frame 28, which may be constructed from, for example, stamped or cast metal, typically is mounted to the front 38 of stator 22. A vent 70 may be provided to permit air flow back and forth into and from the space defined behind or beneath spider 60 and inside pot shell 30.

Voice coil 54 can carry appreciable currents depending upon the design and application of loudspeaker 20. As a result, loudspeaker 20 must have the capability to handle and dissipate a considerable amount of heat. However, in the illustrated construction, although pot shell 30 is constructed from thermally relatively more conductive material, the center pole 44, and particularly magnets 46 constructed from certain materials, frequently has relatively lower thermal conductivity. For example, certain ceramic magnets are used, because of their quite high magnetic flux densities. However, many of such magnets exhibit relatively lower thermal conductivities. This means that while the illustrated pot shell 30 may be capable of adequately transferring heat away from air gap 58, heat transfer away from air gap 58 by the illustrated center pole 44 is frequently much less efficient, resulting in the buildup of heat in the air gap 58. This can adversely affect the performance of the loudspeaker 20, both because the components themselves, for example, the voice coil 54, are adversely affected by heat, and also because the materials used to assemble the loudspeaker 20 components together, for example, adhesives, can be adversely affected by heat.

Figure 3:
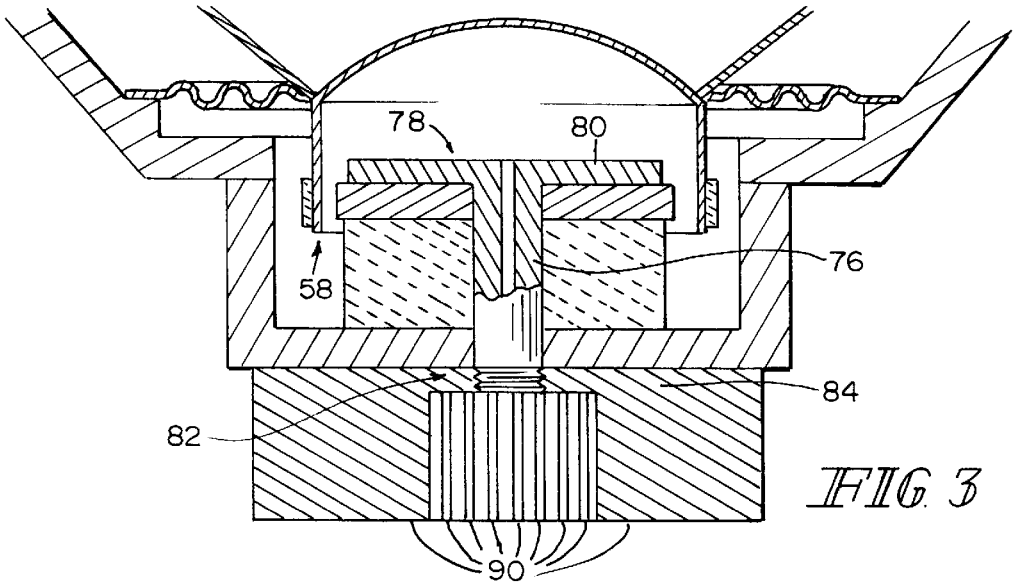
FIG. 3 illustrates a fragmentary axial sectional side elevational view through a dynamic loudspeaker constructed according to the invention; and, FIG. 4 illustrates a fragmentary axial sectional side elevational view through a dynamic loudspeaker constructed according to the invention.
Figure 4:
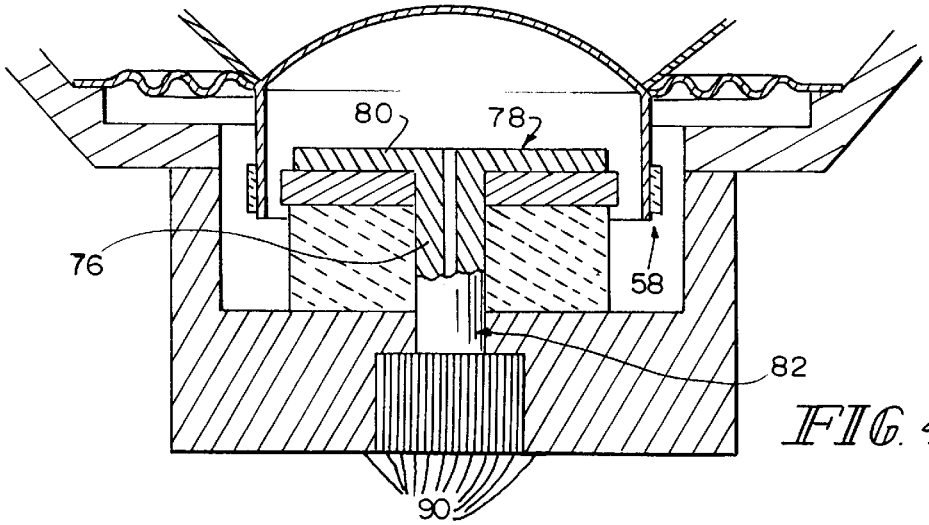

In order to address this problem of heat buildup, passageways 70, 72 and 74 are provided through the back 34 of pot shell 30, through permanent magnet 46, and through center pole piece 50, respectively. During assembly of motor stator 22, passageways 70, 72, 74 are all aligned and a rod-shaped portion 76 of a relatively more thermally conductive heat sink 78 is inserted through these passageways 70, 72, 74. Heat sink 78 also includes a somewhat disk-shaped front, or top, plate 80 which may be congruent with, or, as illustrated, slightly smaller than, the center pole piece 50. Heat sink 78 illustratively is constructed from copper or aluminum or some other thermally highly conductive material. The bottom, or rearward, end 82 of portion 76 can be threaded (FIGS. 1–3), adhesively attached (FIG. 4) or otherwise configured to facilitate attachment of a bottom, or back, plate 84 of heat sink 78. Back plate 84 may be, and illustratively is, constructed from the same relatively more thermally conductive material as front plate 80 and rod-shaped portion 76.

Figure 2:
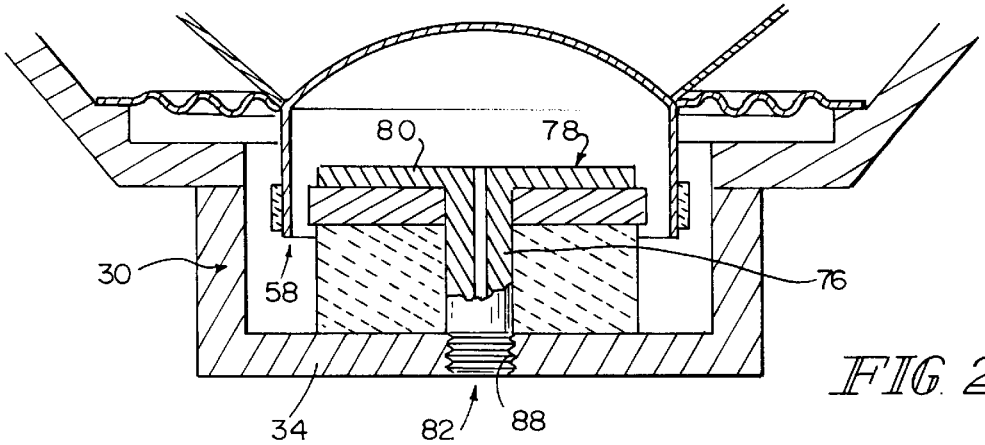
FIG. 2 illustrates a fragmentary axial sectional side elevational view through a dynamic loudspeaker constructed according to the invention.

With reference to FIG. 2, if the pot shell 30 itself is constructed from sufficiently thermally highly conductive material, means, such as a threaded hole 88 can be provided in the back wall 34 of pot shell 30 and the bottom end 82 of rod-shaped portion 76 connected directly to back wall 34. In either event, heat will be conducted through front plate 80 and rod-shaped portion 76 away from air gap 58, thereby reducing heat buildup in the air gap. To enhance this effect even further, bottom plate 84 (FIG. 3) or, in the case in which the bottom plate is eliminated, back wall 34 (FIG. 4), can be finned 90 or otherwise configured to promote radiation of heat away from heat sink 78.

What is claimed is:

1. An electrodynamic speaker comprising a motor stator providing an air gap, a voice coil, a support for supporting the voice coil in the air gap, a diaphragm coupled to the voice coil for reciprocation with the voice coil and a frame for supporting the diaphragm, the motor stator comprising a back wall and a sidewall defining a substantially cup-shaped interior, and a center pole comprising a permanent magnet, the center pole comprising a thermally relatively less conductive material, a passageway through the center pole, and a heat sink having a first portion for surmounting the center pole, the first portion oriented adjacent the air gap, and a second portion coupled to the first portion in heat conducting relation and extending through the passageway to conduct heat away from the air gap through the passageway, the first and second portions comprising a thermally relatively more conductive material.

2. The speaker of claim 1 further comprising a passageway through the back wall, the heat sink further comprising a third portion lying on a side of the back wall opposite the interior, the third portion being coupled to the second portion in heat conducting relation to conduct heat away from the second portion.

3. The speaker of claim 2 wherein the first portion and second portion are formed into a single piece.

4. The speaker of claim 3 wherein the second portion and third portion comprise complementary attachment means.

5. The speaker of claim 2 wherein the second portion and third portion comprise complementary attachment means.

6. The speaker of claim 2 wherein the third portion includes a first surface adjacent the back wall and a second surface opposite the first surface, the second surface contoured to promote radiation of heat therefrom.

7. The speaker of claim 1 wherein the second portion and back wall comprise complementary attachment means.

8. The speaker of claim 7 wherein the back wall comprises a first surface facing the interior and an opposite second surface, the second surface contoured to promote radiation of heat therefrom.

* * * * *